US007062830B2

(12) United States Patent
Alles

(10) Patent No.: US 7,062,830 B2
(45) Date of Patent: Jun. 20, 2006

(54) INSTALLATION OF A RETROFIT HVAC ZONE CONTROL SYSTEM

(75) Inventor: Harold G. Alles, Lake Oswego, OR (US)

(73) Assignee: Home Comfort Zones, Inc., Beaverton, OR (US)

( * ) Notice: Subject to any disclaimer, the term of this patent is extended or adjusted under 35 U.S.C. 154(b) by 117 days.

(21) Appl. No.: 10/717,053

(22) Filed: Nov. 18, 2003

(65) Prior Publication Data

US 2004/0181921 A1 Sep. 23, 2004

Related U.S. Application Data

(63) Continuation-in-part of application No. 10/249,198, filed on Mar. 21, 2003, now Pat. No. 6,983,889.

(51) Int. Cl.
*B21K 21/06* (2006.01)
*G05D 23/00* (2006.01)

(52) U.S. Cl. ..... 29/401.1; 236/51

(58) Field of Classification Search ..... 29/401.1; 254/134.3; 236/51, 49.1, 49.3, 49.4
See application file for complete search history.

(56) References Cited

U.S. PATENT DOCUMENTS 4,662,269 A * 5/1987 Tartaglino ..... 454/255
5,170,986 A * 12/1992 Zelczer et al. ..... 251/61.1
6,786,473 B1 * 9/2004 Alles ..... 254/134.3 FT

* cited by examiner

*Primary Examiner*—John C. Hong
(74) *Attorney, Agent, or Firm*—Blakely Sokoloff Taylor & Zafman, LLP

(57) ABSTRACT

A method of retrofitting a home automation zone climate control system into an existing HVAC system. A respective air tube is pulled through each vent of the ductwork, directly or by an intermediate line, by a parachute which is sucked from the vent to the plenum by a blower attached to the plenum or to a primary trunk of the ductwork. The vent end of each air tube is coupled to a respective inflatable bladder which is disposed within the vent or its duct, and the plenum ends of the air tubes are coupled to a valve system located on or near the plenum. The valve system inflates the bladders to block airflow through their respective ducts, and deflates the bladders to permit airflow, thereby controlling which rooms receive conditioned air.

18 Claims, 6 Drawing Sheets

FIG. 4
FIG. 4A
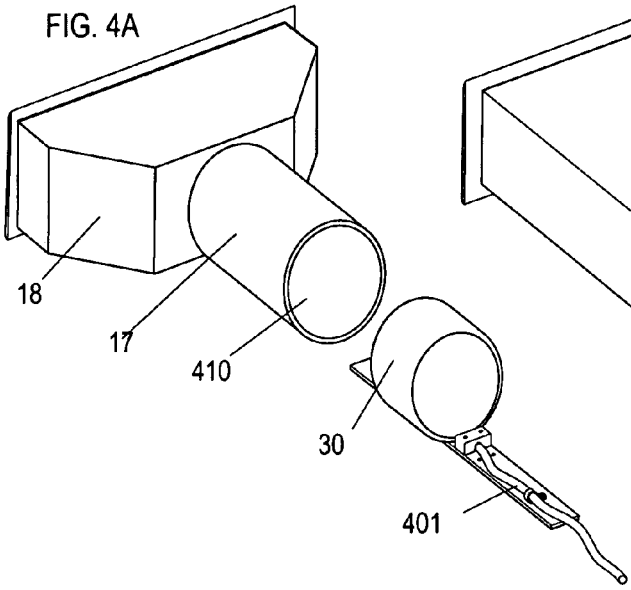
FIG. 4B
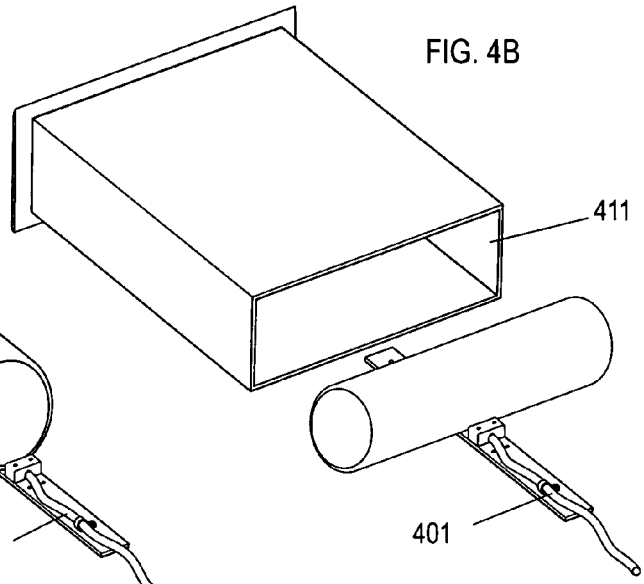
FIG. 4C
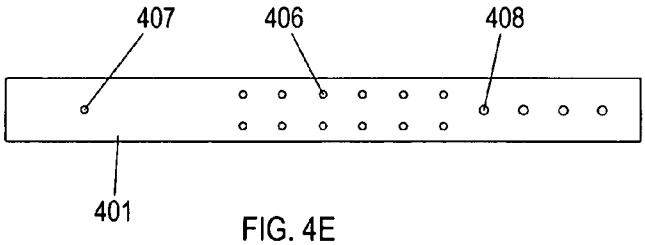
FIG. 4D
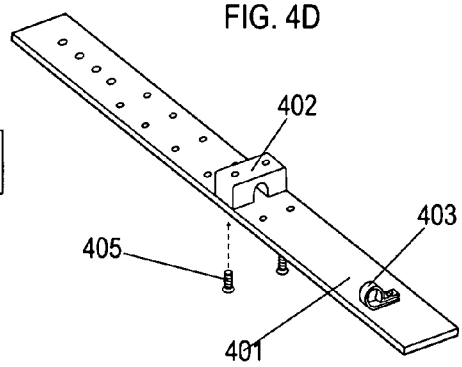
FIG. 4E
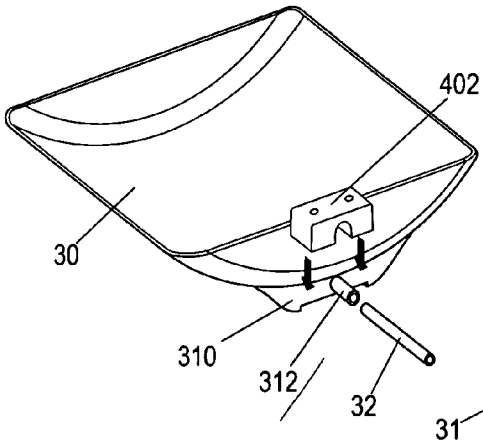
FIG. 4F
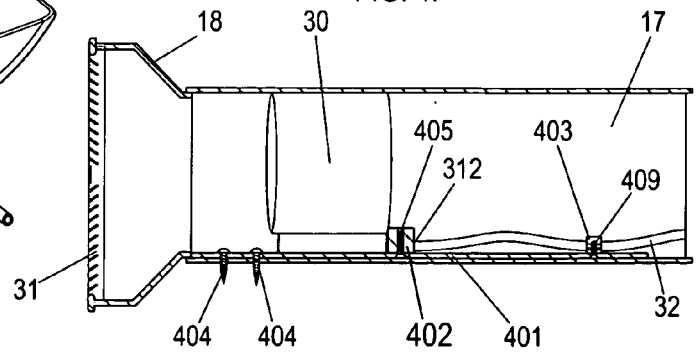

15
1720
2820
2803
2801
2804
2810
2815
2814
2813
2811
2812
2800
18
31
32
2821
2822
2802

INSTALLATION OF A RETROFIT HVAC ZONE CONTROL SYSTEM

RELATED APPLICATIONS

This application is a continuation-in-part of application Ser. No. 10/249,198 entitled "An Improved Forced-Air Climate Control System for Existing Residential House" filed Mar. 21, 2003 by this inventor, which is incorporated by reference as if fully set forth herein. This application is also related to application Ser. No. 10/249,196 entitled "A String to Tube or Cable Connector for Pulling Tubes or Cables through Ducts" filed Mar. 21, 2003 by this inventor.

BACKGROUND OF THE INVENTION

1. Technical Field of the Invention

This invention relates generally to installation of heating, air conditioning, and ventilation (HVAC) systems, and more specifically to a method of retrofitting a zone control system to an existing structure such as a residence.

2. Background Art

Previously, retrofit of e.g. zone control systems to existing HVAC systems has required that the installer cut access holes through the HVAC system ductwork. This makes the installation more difficult, more expensive, and more damaging. The retrofit systems have also included electrical cables and the like, protruding from various undesirable locations, such as from the vent grilles, to provide power for motorized vent dampers and such.

What is needed is a method of installation which does not require cutting any holes through the ductwork, and which does not leave any undesirable components visible.

BRIEF DESCRIPTION OF THE DRAWINGS

The invention will be understood more fully from the detailed description given below and from the accompanying drawings of embodiments of the invention which, however, should not be taken to limit the invention to the specific embodiments described, but are for explanation and understanding only.

FIG. 4 shows installation of the air bladder into a duct of the HVAC system.

DETAILED DESCRIPTION

Forced Air Central HVAC System

Figure 1:
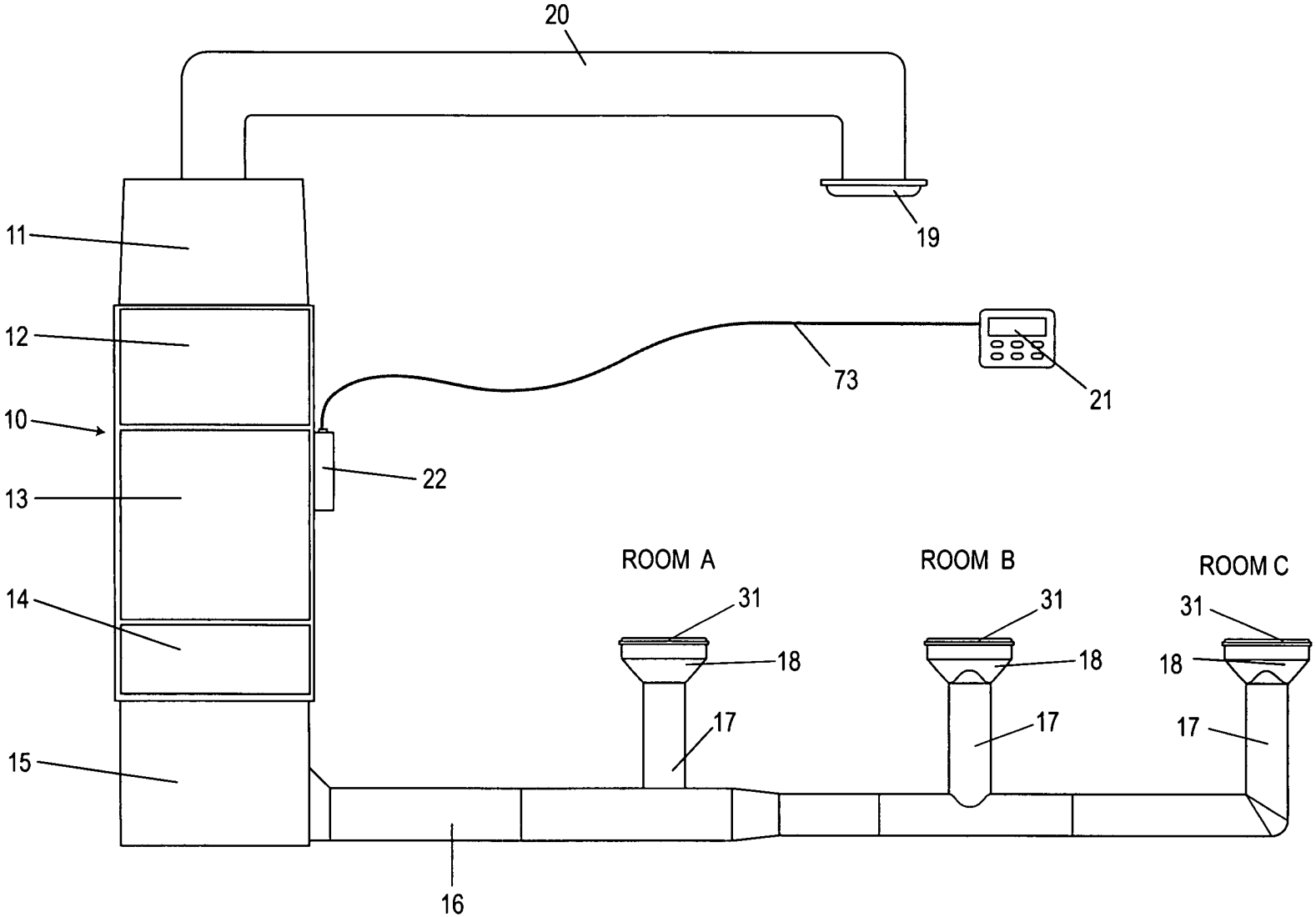
FIG. 1 shows a conventional residential forced-air HVAC system.

FIG. 1 is a block diagram of a typical forced air system. The existing central HVAC unit 10 is typically comprised of a return air plenum 11, a blower 12, a furnace 13, an optional heat exchanger for air conditioning 14, and a conditioned air plenum 15. The configuration shown is called "down flow" because the air flows down. Other possible configurations include "up flow" and "horizontal flow". A network of air duct trunks 16 and air duct branches 17 connect from the conditioned air plenum to each air vent 18 in room A, room B, and room C. Each air vent is covered by an air grill 31. Although only three rooms are represented in FIG. 1, the invention is designed for larger houses with many rooms and at least one air vent in each room. The conditioned air forced into each room is typically returned to the central HVAC unit through one or more common return air vents 19 located in central areas. Air flows through the air return duct 20 into the return plenum.

The existing thermostat 21 is connected by a multi-conductor cable 73 to the existing HVAC controller 22 that switches power to the blower, furnace and air conditioner. The existing thermostat commands the blower and furnace or blower and air conditioner to provide conditioned air to cause the temperature at thermostat to move toward the temperature set at the existing thermostat.

FIG. 1 is only representative of many possible configurations of forced air HVAC systems found in existing houses. For example, the air conditioner can be replaced by a heat pump that can provide both heating and cooling, eliminating the furnace. In some climates, a heat pump is used in combination with a furnace. The present invention can accommodate the different configurations found in most existing houses.

Retrofit Zone Control System

Figure 2:
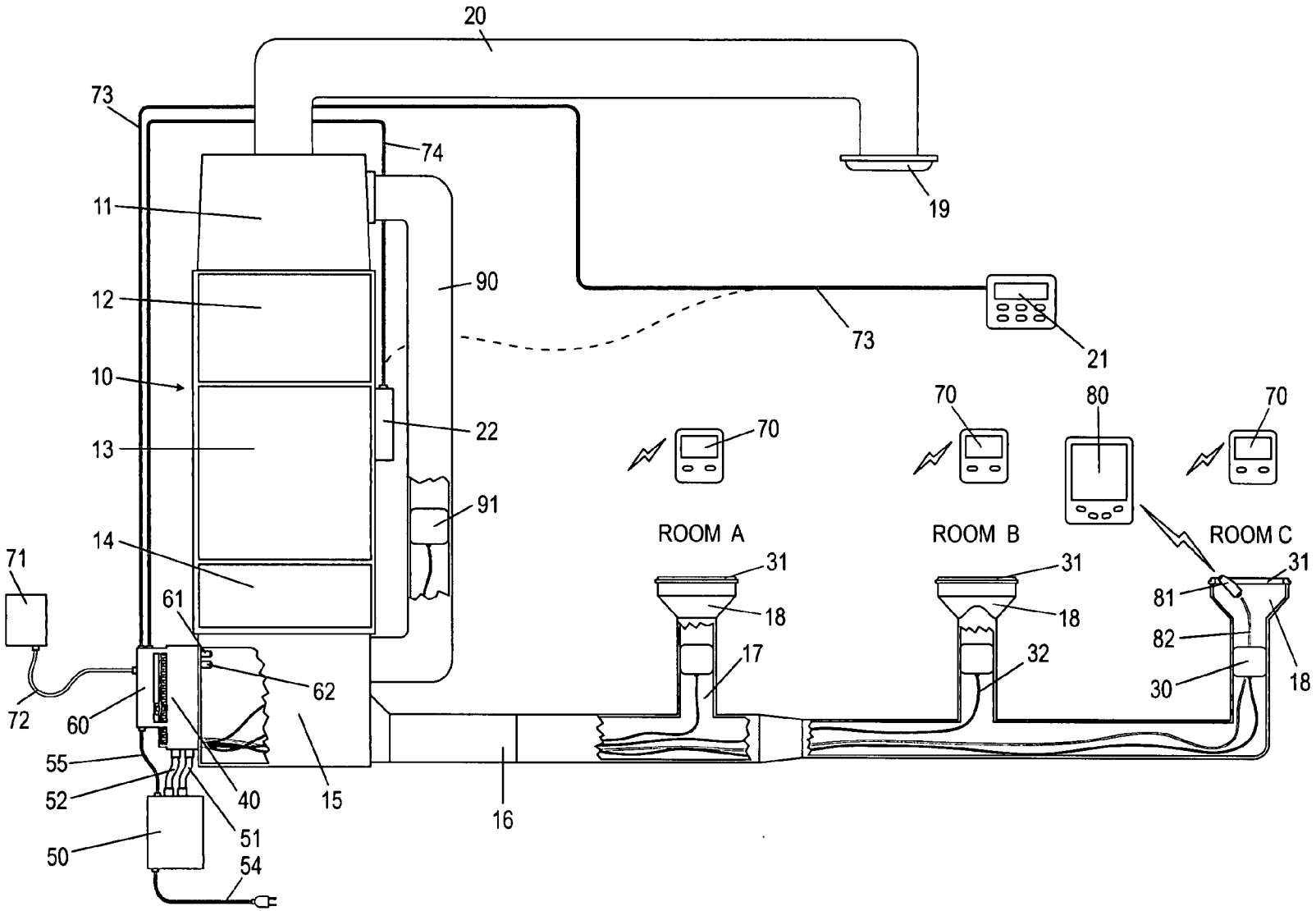
FIG. 2 shows the retrofit zone control system as retrofitted into the HVAC system.

FIG. 2 is a block diagram of the present invention installed in an existing forced air HVAC system as shown in FIG. 1. The airflow through each vent is controlled by a substantially airtight bladder 30 mounted behind the air grill 31 covering the air vent 18. The bladder is, ideally, either fully inflated or fully deflated while the blower 12 is forcing air through the air duct 17. A small air tube 32 (~0.25" OD) is pulled through the existing air ducts to connect each bladder to one air valve of a plurality of servo controlled air valves 40. In one embodiment, the air valves are mounted on the side of the conditioned air plenum 15. There is one air valve for each bladder, or, in some embodiments, one air valve for each set of commonly-acting bladders (such as, for example, if there are multiple vents in a single room).

A small air pump in air pump enclosure 50 provides a source of low-pressure (~1 psi) compressed air and vacuum at a rate of e.g. ~1.5 cubic feet per minute. The pressure air tube 51 connects the pressurized air to the air valves. The vacuum air tube 52 connects the vacuum to the air valves. The air pump enclosure also contains a 5V power supply and control circuit for the air pump. The AC power cord 54 connects the system to 110V AC power. The power and control cable 55 connect the 5V power supply to the control processor and servo controlled air valves and connect the control processor 60 to the circuit that controls the air pump. The control processor controls the air valve servos to set each air valve to one of two positions. The first position connects the compressed air to the air tube so that the bladder inflates. The second position connects the vacuum to the air tube so that the bladder deflates.

A wireless thermometer 70 is placed in each room in the house. All thermometers transmit, on a shared radio frequency of 433 MHz, packets of digital information that encode 32-bit digital messages. A digital message includes a unique thermometer identification number, the temperature, and command data. Two or more thermometers can transmit at the same time, causing errors in the data. To detect errors, the 32-bit digital message is encoded twice in the packet. The radio receiver 71 decodes the messages from all the thermometers, discards packets that have errors, and generates messages that are communicated by serial data link 72 to the control processor. The radio receiver can be located away from the shielding effects of the HVAC equipment if necessary, to ensure reception from all thermometers.

The control processor is connected to the existing HVAC controller 22 by the existing HVAC controller connection 74. The control processor interface circuit uses the same signals as the existing thermostat 21 to control the HVAC equipment.

The control processor controls the HVAC equipment and the airflow to each room according to the temperature reported for each room and according to an independent temperature schedule for each room. The temperature schedules specify a heat-when-below-temperature and a cool-when-above-temperature for each minute of a 24-hour day. A different temperature schedule can be specified for each day for each room.

A graphical display screen 95 with a touch sensitive surface replaces the original thermostat. The wires 73 originally used to connect the thermostat to the HVAC equipment are used to connect the display screen to the control processor. The occupants can view and specify temperature schedules using the display screen and the touch sensitive surface. Energy use data, maintenance requirements, and other aspects of the system can be viewed and controlled through the display screen.

The present invention can set the bladders so that all of the airflow goes to a single air vent, thereby conditioning the air in a single room. This could cause excessive air velocity and noise at the air vent and possibly damage the HVAC equipment. This is solved by connecting a bypass air duct 90 between the conditioned air plenum 15 and the return air plenum 11. A bladder 91 is installed in the bypass 90 and its air tube is connected to an air valve 40 so that the control processor can enable or disable the bypass. The bypass provides a path for the excess airflow and storage for conditioned air. The control processor is interfaced to a temperature sensor 61 located inside the conditioned air plenum. The control processor monitors the conditioned air temperature to ensure that the temperature in the plenum does not go above a preset temperature when heating or below a preset temperature when cooling, and ensures that the blower continues to run until all of the heating or cooling has been transferred to the rooms. This is important when bypass is used and only a portion of the heating or cooling capacity is needed, so the furnace or air conditioner is turned only for a short time. Some existing HVAC equipment has two or more heating or cooling speeds or capacities. When present, the control processor controls the speed control and selects the speed based on the number of air vents open. This capability can eliminate the need for the bypass.

A pressure sensor 62 is mounted inside the conditioned air plenum and interfaced to the control processor. The plenum pressure as a function of different bladder settings is used to deduce the airflow capacity of each air vent in the system and to predict the plenum pressure for any combination of air valve settings. The airflow to each room and the time spent heating or cooling each room is use to provide a relative measure of the energy used to condition each room. This information is reported to the house occupants via the graphical display screen 95.

This brief description of the components of the present invention installed in an existing residential HVAC system provides an understanding of how independent temperature schedules are applied to each room in the house, and the improvements provided by the present invention. The following discloses the details of each of the components and how the components work together to proved the claimed features.

Airflow Control Bladder

Figure 3:
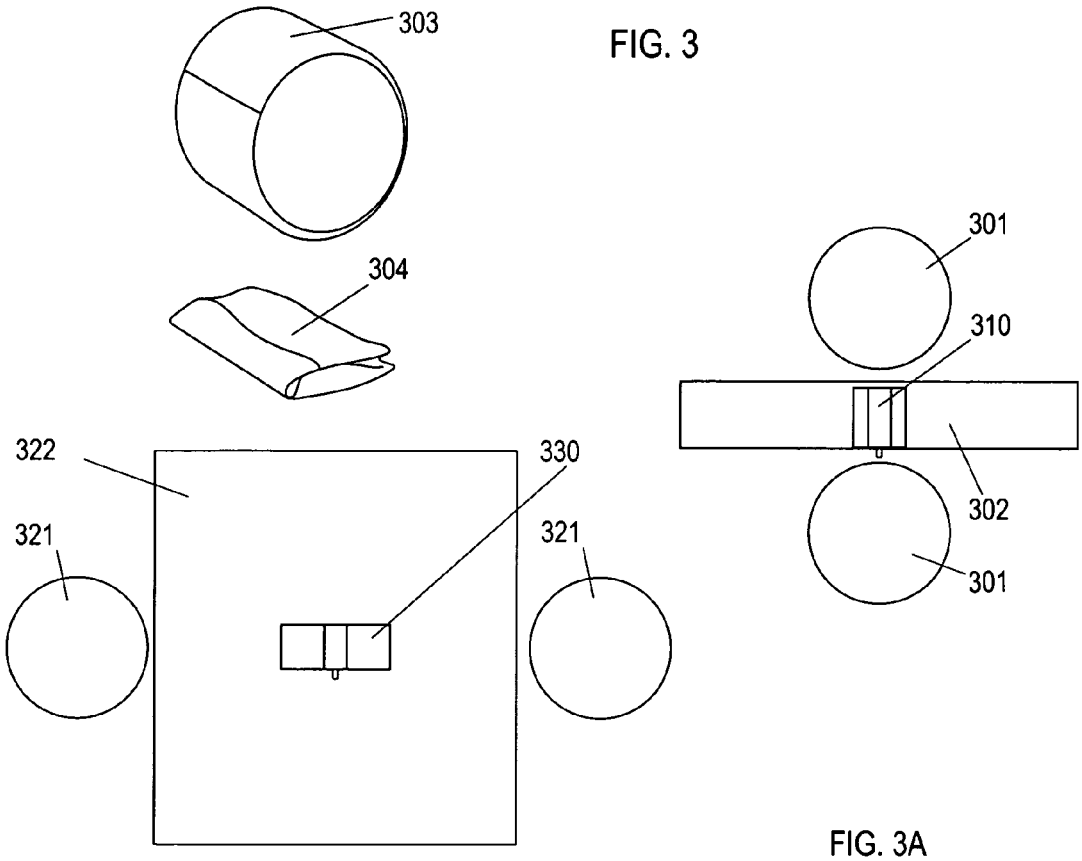
FIG. 3 shows an inflatable air bladder which is used as an airflow control device in the retrofit zone control system.
Figure 3A:
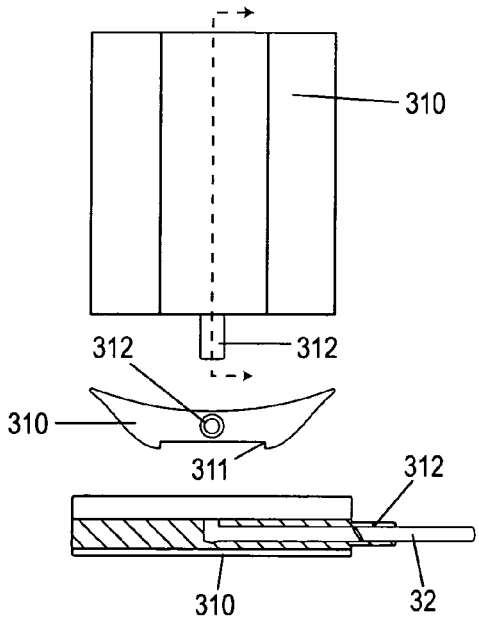

FIG. 3 is a diagram showing the construction of the bladders 30 used as airflow control devices. The bladders are constructed of flexible thin plastic or fabric coated with an airtight flexible sealer. The material is approved by UL or another listing agency for use in plenums. The bladders for controlling airflow in round air ducts are cylinders made by seaming together two circular shapes 301 and a rectangular shape 302. Depending on the material, the airtight seams are heat sealed or glued. The material is only slightly elastic so the inflated size is determined by the dimensions of these shapes. An air tube connector 310 is sealed to the rectangular shape 302. The air tube connector is molded from flexible plastic approved for use in plenums. FIG. 3A shows more detail of the air tube connector, which has an air tube socket 312 sized so that it tightly grips the outside of the air tube 32. The air tube connector provides the air path from the air tube to the inside of the bladder. The air tube connector is contoured to match the curvature of the round air duct and has a notch 311 to fit a mounting strap. This shape prevents conditioned air from leaking around the bladder when it is inflated. The inflated bladder 303 is about 110% the diameter of the air duct and its height is about 75% of the diameter. When inflated in the duct, the cylinder wall is pressed firmly against the inside of the air duct, effectively blocking all airflow. The deflated bladder 304 presents a small cross-section to airflow and restricts airflow by less than 10%. The standard round duct sizes connecting to air vents in residential installations are 4", 6", and 8". Bypass 90 can be 6", 8", or 10" in diameter. A total of only 4 different round duct bladder sizes are needed for residential installations.

Figure 3B:
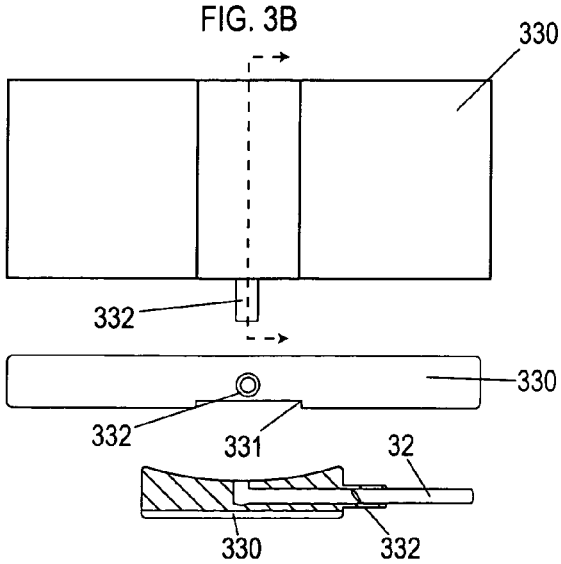

The bladders for controlling airflow in rectangular ducts are also cylinders made by seaming together two circular shapes 321 and a rectangular shape 322. The cylinder is oriented so that the axis of the cylinder is parallel to the widest dimension of the duct. The height of the cylinder is about 110% of the wider dimension of the duct. The cylinder diameter is at least 110% of the narrower dimension of the duct, but can be as much as 200%. When inflated, the bladder accepts only enough air to fill the air duct. FIG. 3B shows more detail of the air tube connector 330, which is contoured for the flat surface of the rectangular duct and it has a notch 331 to fit a mounting strap and air tube socket 332 sized to fit the outside of the air tube 32.

FIG. 4 shows several views of the method for mounting the bladder 30 in an air duct 17 at an air vent 18 covered by air grill 31. Referring to FIG. 4E, the air tube 32 is inserted into the air tube socket 312 in the air tube connector 310 sealed to the bladder 30 shown with the top portion cut away. Mounting clamp 402 compresses the air tube socket around the air tube.

FIG. 4C is a plain view of the mounting strap, which is made from thin metal (18 gauge) and is approximately 1" by 12". Hole 407 is used to secure the air tube to the mounting strap. One pair of holes 406 are used to secure the mounting clamp 402 to the mounting strap. Two of the holes 408 are used to secure the mounting strap to the inside of the air vent or air duct at the air vent.

FIG. 4D is a perspective drawing showing the mounting clamp 402 connecting to the mounting strap 401. The mounting clamp straddles the air tube socket 312 (shown in FIG. 4E) and two bladder clamp screws 405 pass through holes 406 in the mounting strap and screw into the mounting clamp. Several pairs of holes 406 (shown in FIG. 4C) are provided so the bladder can be positioned for the most effective seal of the air duct. The screws 405 are self-tapping with flat heads that match counter-sinks pressed into the holes 406 in the mounting strap. Tightening the bladder clamp screws 405 cause the bladder clamp 402 to compress the air tube socket 312 firmly around the air tube 32, securing the bladder to the mounting strap and ensuring an air tight seal between the air tube and the bladder. When tightened, the screw heads are flat with the bottom surface of the mounting strap, and the mounting strap fits in the notch 311 of the air tube connector 310 so the mounting strap is flat with the air tube connector.

FIG. 4F is a cross-section view of the assembled bladder installed in an air duct 17 connecting to air vent 18 covered by air grill 31. The air tube 32 is secured to the mounting strap 401 by the air tube clamp 403 (also shown in FIG. 4D) using a screw 409 and nut through hole 407 (shown in FIG. 4C). The air tube clamp transfers any tension on the air tube to the mounting strap and prevents strain on the connection between the air tube and the bladder. The mounting clamp 402 is connected to the mounting strap by two screws 405 and compresses the air tube socket 312 and secures the bladder 30 to the mounting strap. The mounting strap is secured to the inside of the air duct or air vent by two screws 404 through holes 408 (shown in FIG. 4C). Some air vents are constructed with in integrated section of air duct several inched long, which fits inside the connecting air duct 17. The inflated bladder can make contact with this extension of the air vent or it can make contact in the air duct when the extension is not part of the air vent.

FIG. 4A is an exploded perspective view of the assembled bladder 30 and mounting strap 401 fitting into the air duct 17 connected to air vent 18. The inside of the air duct or air vent 410 where the bladder makes contact must be a smooth surface. If sharp sheet metal edges or screws are present, they are cut or smoothed and covered with duct mastic or duct tape to form a smooth surface and contour.

FIG. 4B is an exploded perspective view of an assembled bladder and air tube secured to amounting strap 401 for mounting inside a rectangular air duct 411.

All installation and assembly work is done in the room where the air vent is located. The air grill is removed and an air tube 32 is pulled from the air vent to the plenum 15. The air tube is secured to the mounting strap 401 and the proper size and shape bladder 30 is secured to the mounting strap. The inside surface 410 of the air vent or air duct is prepared by smoothing, cutting, or covering sharp edges and screws. In many cases, no preparation is required. This surface is chosen so it is close enough to the front of the air vent to provide convenient access for any surface preparation work. The mounting strap is inserted into the air vent and the mounting strap is bent and position so the inflated bladder meets the surface 410. The mounting strap is then secured to the inside of the air vent by one or two sheet metal screws. The air grill is then reinstalled. After installation, the bladder is hidden by the air grill, and there are no visible signs of installation. The installation requires no other modification to the air duct, air vent, or air grill, and no other access to the air duct is required.

Central Components

Figure 5:
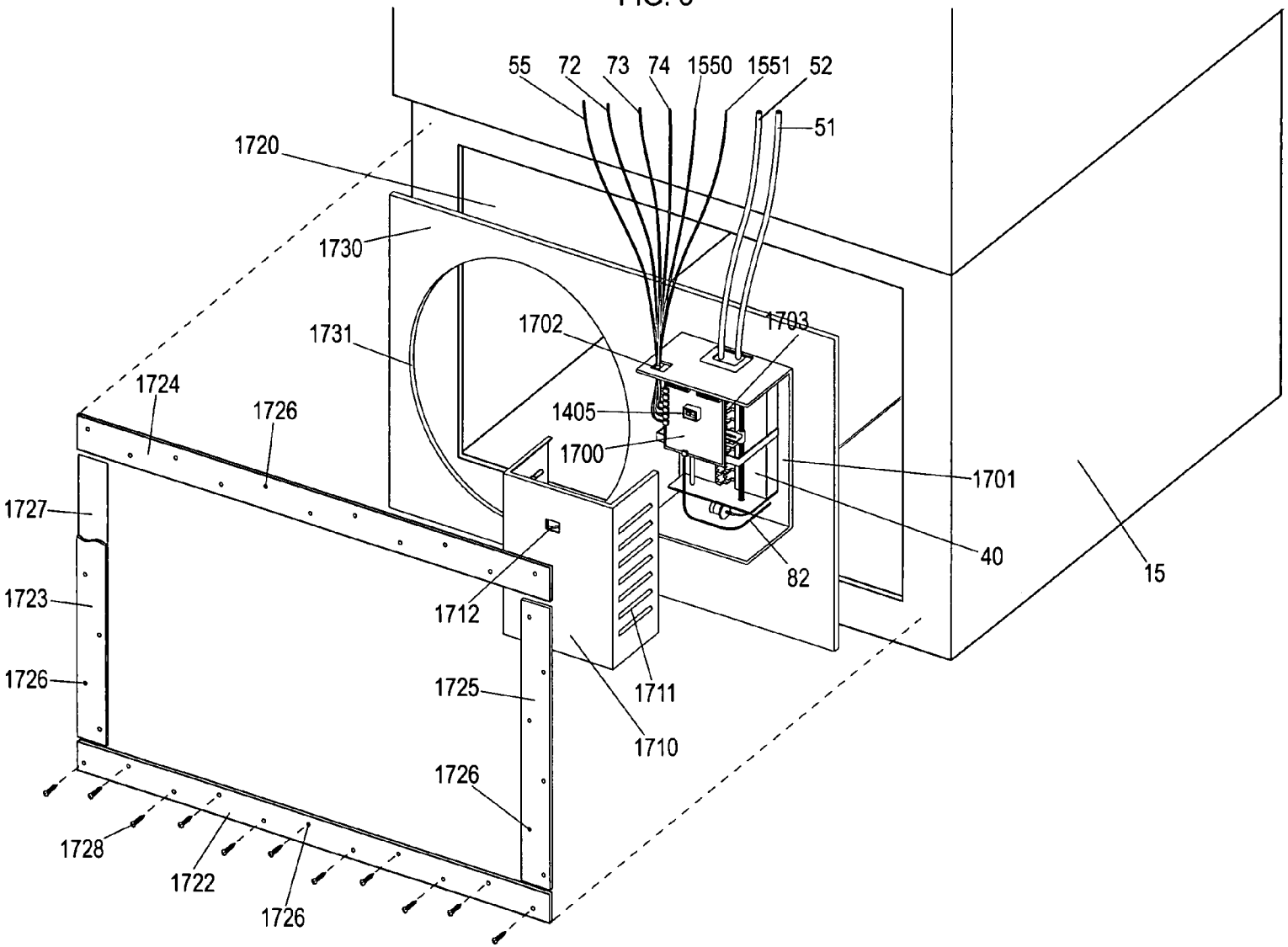
FIG. 5 shows installation of the valve manifold into a plenum of the HVAC system.

FIG. 5 is an exploded perspective view of the system components that are mounted at a central location, such as on the conditioned air plenum 15. The control processor 60 and interface circuits are built on a PCB (printed circuit board) 1700 approximately 5"×5", which is mounted to the main enclosure base 1701. The PCB includes the terminals and sockets used to connect the control processor signals to the servo controlled air valves 40, the power and control connection 55, the temperature sensor, the pressure sensor, the radio receiver connection, the existing thermostat connection 73, the existing HVAC controller connection 74, the RS232 connection 1551, and the remote connection 1550. Side 1703 of the main enclosure base 1701 has access cutouts and restraining cable clamps 1702 for the power and control connection, the radio connection, the existing thermostat connection, the existing HVAC controller connection, the RS232 connection 1551, and the remote connection 1550 (when used).

The main enclosure base 1701 has a cutout sized and positioned to provide clearance for the valve header on the valve block and valve block. The servo controlled air valve 40 is mounted to the main enclosure base 1701. The main enclosure base also has cutouts for the pressure and temperature sensors to access the inside of the plenum and for the link connection to pass from the plenum to its connector on the PCB 1700. The PCB is mounted above the air valve blocks. Side 1703 also has cutouts for the pressure air tube 51 and vacuum air tube 52 connected to the air-feed tee.

The main enclosure top 1710 fits to the base 1701 to form a complete enclosure. Vent slots 1711 in the main enclosure top provide ventilation. A cutout 1712 in the main enclosure top matches the location of switch 1405 on PCB 1700 so that when the main enclosure top is in position, the switch 1405 can be manually switched to either position.

Installation of Central Components

To install the present invention, a hole 1720 approximately 8"×8" is cut in the side of the conditioned air plenum 15. The hole provides access for the process used to pull the air tubes 32 and to provide access when attaching the air tubes. The main enclosure base 1701 is approximately 9"×9". The pressure and temperature sensors and the air tube headers are arranged to fit inside the 8"×8" hole cut 1720 in the side of the plenum.

After all connections from inside the plenum are made, the main unit is attached to the plenum with sheet metal screws and sealant so as to cover and seal the hole 1720 in the side of the plenum.

Installation of Control Tubes for Airflow Control Bladders

Figures 6, 6A, 6B, 6C, 6D, 6E, 6F, 6G, 6H:
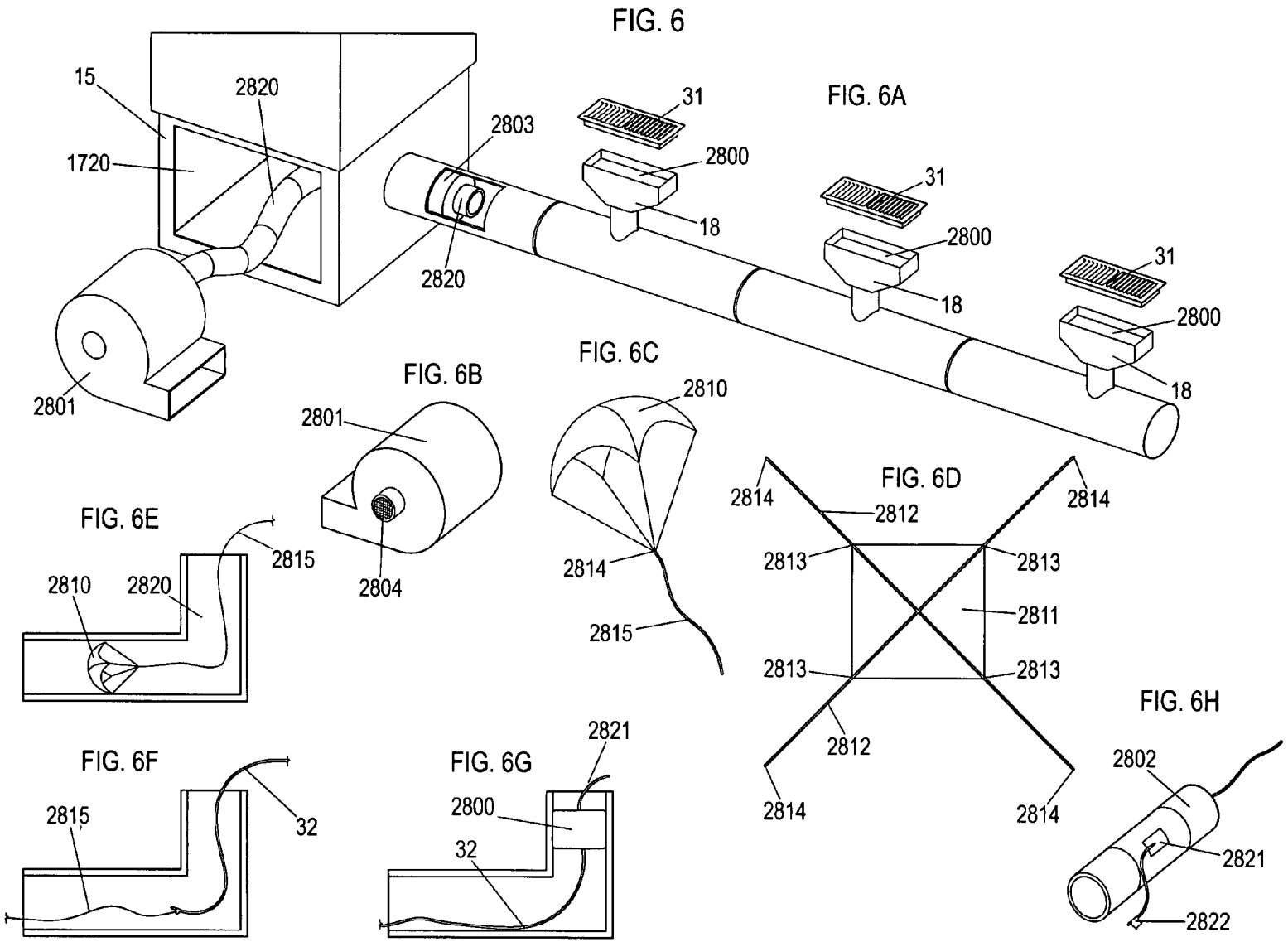
FIG. 6 shows installation of the pneumatic control tubes into the ductwork of the HVAC system.

The present invention is designed for easy installation in existing residential houses. Access is required only to the air vents and the central HVAC plenum. All required installation processes are known to those skilled in the art of HVAC installation with the exception of pulling the air tubes through the air ducts. The present invention includes a novel process for pulling the air tubes trough the air ducts. The description of the process refers to the views shown in FIG. 6. The method has the following steps, which do not necessarily have to be performed in exactly the order listed:

1. Referring to FIG. 6A, all of the air grills 31 are removed and every air vent 18 connected by an air duct to the plenum 15 is sealed using an oversized block of foam rubber 2800. Alternatively, the vents could be blocked by some other method, with or without first removing its grill. Alternatively, the grills could be removed, wrapped in plastic, and replaced in their vents. In some instances, it may not be necessary to block every single vent.

2. Referring to FIG. 6A, the access hole 1720 is cut in the air plenum 15.

3. Referring to FIG. 6A, a high-speed installation blower 2801 is connected by flexible duct 2802 to hole 1720. A substantially airtight seal 2803 is formed at the end of the flexible duct between the outside of the flexible duct and the inside of the plenum. This seal can be made using a thin foam rubber gasket. It is necessary to prevent airflow from the return air plenum. This can be accomplished by removing the air filter (not shown) which is typically housed within the plenum, covering it with plastic film, and reinstalling it. Alternatively, each return air vent could be sealed, such as by the same method used to seal the output vents. Alternatively, since the return vent grills do not need to be removed, the vents could be sealed using plastic film and tape. The installation blower is connected so that the airflow is from the room air vents 18 towards the conditioned air plenum 15. Alternatively, the airflow could be in the opposite direction, but this may in some instances make the installation more difficult. FIG. 6B is a reverse view of the installation blower 2801 and its input 2804 that is connected to the flexible duct 2802. After all of the vents and return air paths are sealed, the duct system should be substantially airtight. When the blower is run, a vacuum is created throughout the duct network. Typical blowers can generate a maximum vacuum of 0.5" to 1.0" inches $H_2O$. The actual vacuum produced can be used as a measure of the leakage of the duct system. If the leakage is large, the vacuum will be much less than the blower can create, indicating the duct system should be repaired before completing the installation.

4. A perspective view of an inflated parachute 2810 is shown in FIG. 6C. FIG. 6D illustrates the construction of the parachute. The parachute is made from a sheet of high strength plastic film 2811 about 0.002 inch thick and 16" by 16". Two strong strings 2812 approximately 6-feet long cross the plastic film and connect at the four corners 2813. Again referring to FIG. 6C, the four ends 2814 are connected to a single long strong pull string 2815. Typically, a high quality 200 lb test fishing line is used for pull string 2815.

5. Referring to FIG. 6D, the seal in the air vent 2820 furthest from the blower 2801 is removed, and the blower is turned on. This creates a large airflow from the one open vent, through the air duct, to the blower in the air plenum 15.

6. Referring to FIG. 6E, the parachute 2810 is introduced into the air vent while the pull string 2815 is held under tension. The airflow inflates the parachute sealing its edges to the inside of the air duct. This creates a strong pull on the parachute and in turn the pull string.

7. The parachute is pulled through the air duct toward the blower 2801 in the conditioned air plenum 15 as the string 2815 is let out.

8. If the parachute snags, it can be freed by pulling the string back and forth. This temporarily collapses the parachute so that turbulence in the airflow helps find another path for the parachute.

9. When the parachute reaches the blower or the plenum, the blower is turned off, the flexible duct 2802 is removed from the blower, and the parachute is retrieved. A screen over the input 2804 (FIG. 6B) prevents the parachute from entering the blower.

10. Referring to FIG. 6F at the air vent, the air tube 32 is connected to the air vent end of pull string 2815.

11. Referring to FIG. 6A, the parachute end of pull string 2815 is used to pull the air tube through the air duct to the end of the disconnected flexible duct 2802. Alternatively, the string and air tube may be pulled in the opposite direction, from the plenum to the vent. Optionally, the collapsed parachute may be pulled with them back to the vent, for retrieval for use at a next vent. The connector described in co-pending application Ser. No. 10/249,196 may optionally and advantageously be used in connecting the string to the air tube, and in pulling the string to draw the air tube through the ductwork.

12. Referring to FIG. 6H, which is a detailed view of the end of the flexible air duct 2802, the pull string 2815 is removed from the air tube. The air tube is labeled (ref. no. 2822) to associate it with the particular air vent 2820, passed through an air seal 2821 on the side of the flexible duct 2802, and the flexible duct is reattached to the installation blower 2801. Alternatively, rather than having the end of the air tube extend out an opening in the side of the flexible duct, the air tube could be passed between the foam rubber which seals the end of the flexible duct to the duct trunk, and the inner surface of the duct trunk.

13. Referring to FIG. 6G at the air vent, the air tube is cut from the supply spool, secured inside the room 2821, and the air vent is resealed with the foam block 2800.

14. Process steps 5 through 13 are repeated for each of the remaining air vents, in order of furthest to nearest to the plenum 15 or in any other suitable order.

15. After all of the air tubes are pulled, the flexible duct and seal are removed from the conditioned air plenum, the foam blocks are removed from the air vents, and the grills are replaced.

This process typically requires five to fifteen minutes per air tube. If obstructions in an air duct block the parachute, then other conventional and more time consuming methods are used. After the air tubes are pulled, the installation can proceed using standard techniques.

In another embodiment, the air tube could be directly pulled through by the parachute, without the intermediate steps of the parachute pulling a string and the string being used to pull the air tube.

Although a parachute is one very useful means for pulling the string or air tube through the ductwork, other tools are within the scope of this invention. For example, the blower could be used to blow or suck a ball through the ductwork. Or, the string could be attached to a "tumbleweed" or "porcupine" type of structure which has a large overall surface area made of smaller objects protruding from a central core, such as a rubber ball having a multitude of turkey feathers stuck into it at various angles. Another alternative is a wad of plastic bags or the like. The object will, ideally, exhibit (i) a large surface area for good wind resistance and thus good pulling force, (ii) sufficient flexibility to pass around the various corners and edges of the ductwork, (iii) the ability to adapt to the various diameters and shapes of ducts and trunks which it will encounter, (iv) a resistance to snagging, and (v) low cost.

Although the preferred installation method is to route the air tubes into the plenum, an installer could, alternatively, cut a hole through the primary trunk leaving the plenum, route the air tubes out this hole, seal the hole around the air tubes, and install the valve system and other central components at this location, rather than at the plenum. This still avoids any need for accessing the ducts, vents, and intermediate trunks, which will typically be more difficult to access than the primary trunk. In some building configurations, this less optimal installation may be preferred, such as if the plenum itself is hard to access, or if there are security concerns which require that the home automation controller and the valve system be located e.g. under the house rather than in the garage with the furnace and plenum.

System Diagnosis

Optionally, the installer may also perform diagnostic analyses on the HVAC system, before removing the installation equipment. It is known that blowers provide different air pressure at different rates of airflow. The less backpressure or obstruction that is placed on the blower's output, the higher the airflow and the lower the pressure will be; conversely, the more the output is obstructed, the lower the airflow and the higher the pressure will be. With all of the vents blocked, the installer turns on the blower and measures the pressure inside the duct trunk network (such as with a pressure gauge placed inside the duct trunk or extending through the flexible duct opening 2821). A pressure-versus-airflow chart, ideally one customized for that particular blower unit, will tell the installer how much airflow is escaping the system. Optionally, the installer may take into account the number of vents (which may not have absolutely airtight seals created by their foam blocks or other temporary sealing mechanisms), to determine an amount of leakage. Such leakage may be caused by, for example, ducts which have come loose from their trunks, duct or trunk joints which have come loose or whose duct tape has failed, and so forth.

Such failures are highly undesirable, not only because the heated or cooled conditioned air is not reaching one or more of the rooms, but also because it may be escaping the house altogether, such as where the failure occurs in a subfloor or attic crawlspace, in which case the conditioned air is venting to the outside of the house. The homeowner is paying to heat or cool the outdoors, finite natural resources are being wasted, and the residents are not as comfortable as they would otherwise be.

The installer may measure airflow through each individual vent in the same manner. The installer removes the foam or other seal from the vent, operates the blower, measures the pressure, and calculates the airflow. The installer can perform this operation for each successive vent. If any vent has an airflow calculation (or, in other words, pressure measurement) which is out of range with respect to the others, the installer may determine that there is an obstruction or other problem with that vent's duct, and may take appropriate corrective measures. By taking measurements with different sets of two or more vents unblocked at a time, the installer may deduce other problems, such as too many ducts run from a common trunk.

The system of this invention may be installed in old, existing residential or commercial buildings, or it may be installed in newly constructed buildings. In the latter case, the diagnostic analysis capabilities of this invention may be used to validate the quality of the work previously done by the installers of the basic HVAC system, to find and fix problems before construction continues (such as covering up ductwork by installing drywall), before signing off on or paying for the HVAC installation, and/or before the closing of the real estate transaction. In fact, the retrofit system of this invention could even be used to perform such analysis even if the retrofit system is not being permanently installed; it could be temporarily installed simply as a quality control means for the basic HVAC system.

Similar analyses may be performed by the home automation system itself, long after installation, by using the inflatable bladders to block the vents and by using the plenum pressure sensor 62 to measure the pressure. After installation, the controller could take a set of measurements, such as: pressure with all vents closed, pressure with each individual vent open by itself, pressure with each combination of two vents open, and so forth. The controller could save this set of measurements as a baseline, and then periodically re-run the diagnostic test set to see if any of the measurements has significantly diverged from its baseline, indicating that something has changed in the HVAC system, such as a duct coming loose from its trunk, or a child having thrown a stuffed animal down a duct, and the like.

Although the invention has been described with reference to a conventional HVAC system having common return air intake vents, it may also be used in a system in which some or all of the rooms have their own, individual return air vents. In either case, the installation may include installing air tubes and inflatable bladders into the return air vents or ducts, and the zone climate controller may individually operate the return air vents, to provide still greater performance improvements. For example, if each room has both a conditioned air vent and a return air vent, the controller can, with complete specificity, move air from one room to another room.

CONCLUSION

From the forgoing description, it will be apparent that there has been provided an improved forced-air zone climate control system for existing residential houses. Variation and modification of the described system will undoubtedly suggest themselves to those skilled in the art. Accordingly, the forgoing description should be taken as illustrative and not in a limiting sense.

When one component is said to be "adjacent" another component, it should not be interpreted to mean that there is absolutely nothing between the two components, only that they are in the order indicated. The various features illustrated in the figures may be combined in many ways, and should not be interpreted as though limited to the specific embodiments in which they were explained and shown. Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed is:

1. In a forced air HVAC system having a network of air ducts connecting a central discharge plenum to a plurality of air vents, a method for installing an air tube from said plenum to at least one of said air vents, comprising:

1) connecting a blower to said plenum;
2) providing a flexible and expandable air flow restricting device adapted for passing through said air ducts and substantially restricting airflow at any location in said air ducts;
3) providing a string connecting to said restricting device, said string sufficiently long to connect from said air ducts to said plenum, and sufficiently flexible to easily follow a path through said air ducts, and sufficiently strong so as not to break when used to pull an air tube through said air ducts;
4) blocking all of the air vents but one air vent;
5) inserting said restricting device into said one air vent;
6) running said blower such that air flows at a rate sufficiently fast to pull said restricting device and said string from said one air vent to said plenum;

7) providing tension on said string while letting out said string such that said restricting device moves through said air ducts at a practical and reasonable speed until said restricting device reaches said plenum;

8) stopping said blower when said restricting device arrives at said plenum;

9) connecting said air tube to said string at said one of air vents;

10) accessing said string at said plenum; and 11) pulling said string at said plenum such that said air tube is pulled from said one of air vents through said air ducts to said plenum;

whereby said air tube is installed from said one of air vents to side plenum by accessing said air ducts only at said one of air vents and at said plenum.

2. The method of claim 1 further including repeating steps 4) through 11) for each of the other said air vents.

3. The method of claim 1 wherein providing said restricting device further includes:

providing a substantially square or round sheet of plastic film of area of approximately the same size as a largest cross section area of any said air duct;

providing at least three strings of length approximately equal to a largest linear dimension of said sheet;

connecting one end of each said strings approximately equally spaced around a perimeter of said sheet; and connecting the other ends of said strings to said string provided in said step 3);

whereby said flexible and expandable airflow restricting device is a simple parachute.

4. The method of claim 1 further including a method for enabling said restricting device to pass by a snag, comprising:

a) sensing said tension in said string abruptly decreasing, indicating said restricting device is snagged;

b) pulling said string back towards said air vent until said tension returns to an approximate value before said snag;

c) releasing said string such that said restricting device quickly accelerates;

d) monitoring said string as said restricting device accelerates and reapplying said tension to said string after said restricting device has passed said snag; and e) repeating said steps b) through d) until said restricting device has passed said snag;

wherein a length of said string pulled back toward said air duct is varied and wherein the rate of releasing said tension is varied;

whereby said restricting device passes by said snag.

5. A method of installing a control system in an HVAC system which includes a plenum, at least one trunk, and a plurality of ducts each having a vent, the method comprising:

coupling a blower to one of the plenum and the trunk;

operating the blower to provide airflow through the ducts into the one of the plenum and the trunk;

inserting an air drag device into one of the vents, the air drag device having coupled thereto one of a line and an air tube;

waiting until the air drag device has traveled from the vent substantially to the blower;

removing the air drag device from the HVAC system;

if the air drag device had the line coupled thereto, using the line to pull the air tube from the vent substantially to the blower;

coupling a vent end of the air tube to an inflatable bladder disposed within one of the vent and a duct coupled to the vent; and extending a plenum end of the air tube into the plenum.

6. The method of claim 5 wherein:

the air drag device comprises a parachute.

7. The method of claim 5 further comprising:

repeating the steps from the inserting step onward, for additional ones of the vents.

8. The method of claim 5 further comprising:

blocking some of the vents to increase airflow through non-blocked vent(s).

9. The method of claim 8 wherein:

blocking a vent comprises using an oversized block of foam to block one of the vent and a duct coupled to the vent.

10. The method of claim 8 wherein:

blocking some of the vents comprises blocking all but one of the vents at a time.

11. The method of claim 5 further comprising:

blocking all of the vents;

measuring a pressure within one of the trunk, the plenum, and the blower; and in accordance with the measured pressure, determining an airflow in order to determine whether there are leaks in the HVAC system.

12. The method of claim 11 further comprising:

the pressure being measured within the plenum; and blocking airflow into an inward airflow end of the plenum, the trunk being coupled to an outward airflow end of the plenum.

13. The method of claim 5 further comprising:

removing a grill from the vent prior to inserting the air drag device; and replacing the grill after coupling the vent end of the air tube to the inflatable bladder.

14. The method of claim 13 further comprising:

providing an access hole through an accessed one of the plenum and the trunk;

coupling the plenum end of the air tube to a valve system including a pressure and vacuum pump;

mounting the valve system at a location in close proximity to the plenum; and sealing the access hole.

15. The method of claim 14 further comprising:

repeating the steps from the inserting step to the extending step, for additional ones of the vents.

16. The method of claim 15 further comprising:

performing the steps from the inserting step to the extending step, for a bypass coupled to the plenum.

17. The method of claim 15 further comprising:

performing the steps from the inserting step to the extending step, for a return air duct of the HVAC system.

18. The method of claim 14 wherein:

mounting the valve system comprises coupling the valve system to the plenum.

* * * * *